United States Patent [19]

Heinrich

[11] 4,289,068

[45] Sep. 15, 1981

[54] DUMP COMPACTOR FOR REFUSE

[76] Inventor: Richard J. Heinrich, Rte. 3, Box 452, Staunton, Va. 24401

[21] Appl. No.: 153,423

[22] Filed: May 27, 1980

[51] Int. Cl.[3] ..... B30B 15/30

[52] U.S. Cl. ..... 100/215; 100/229 A; 141/73; 141/364

[58] Field of Search ..... 100/215, 229 A; 414/293, 680; 222/160; 141/364, 365, 73, 80

[56] References Cited

U.S. PATENT DOCUMENTS

| | | | |
|---|---|---|---|
| 2,744,670 | 5/1956 | Bendot | 222/166 X |
| 2,984,174 | 5/1961 | Jones | 100/215 X |
| 3,250,414 | 5/1966 | Pioch | 100/229 A |
| 4,149,457 | 4/1979 | Smith | 100/215 X |
| 4,230,037 | 10/1980 | Schmalz | 100/215 X |

FOREIGN PATENT DOCUMENTS

| | | | |
|---|---|---|---|
| 1938150 | 2/1971 | Fed. Rep. of Germany | 100/215 |
| 577379 | 7/1976 | Switzerland | 100/229 A |
| 632582 | 11/1978 | U.S.S.R. | 100/215 |

*Primary Examiner*—Billy J. Wilhite
*Attorney, Agent, or Firm*—B. P. Fishburne, Jr.

[57] ABSTRACT

A high volume refuse compacting apparatus utilizes a commercial horizontal axis ram compactor as a base and upon this unit are mounted in tandem relationship a relatively stationary hopper bin and a coacting power-operated pivotal dumping bin which is elevated to a steep angle to feed the hopper bin with refuse by gravity action. A bottom opening of the hopper bin is in registry with a provided opening in the compactor unit above the ram thereof. Corresponding side walls of the hopper and dumping bins are made shallow to facilitate side loading of the apparatus. A scissoring action of the side walls of the hopper and dumping bins substantially eliminates refuse spillage.

8 Claims, 8 Drawing Figures

FIG.1
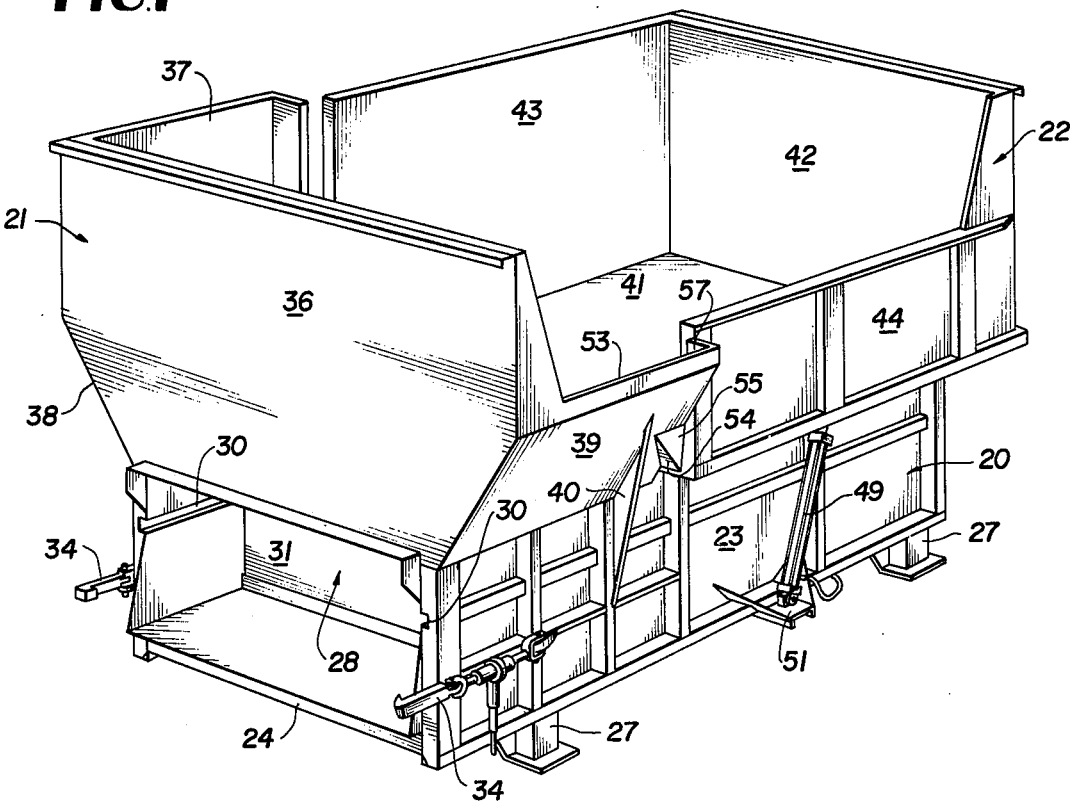
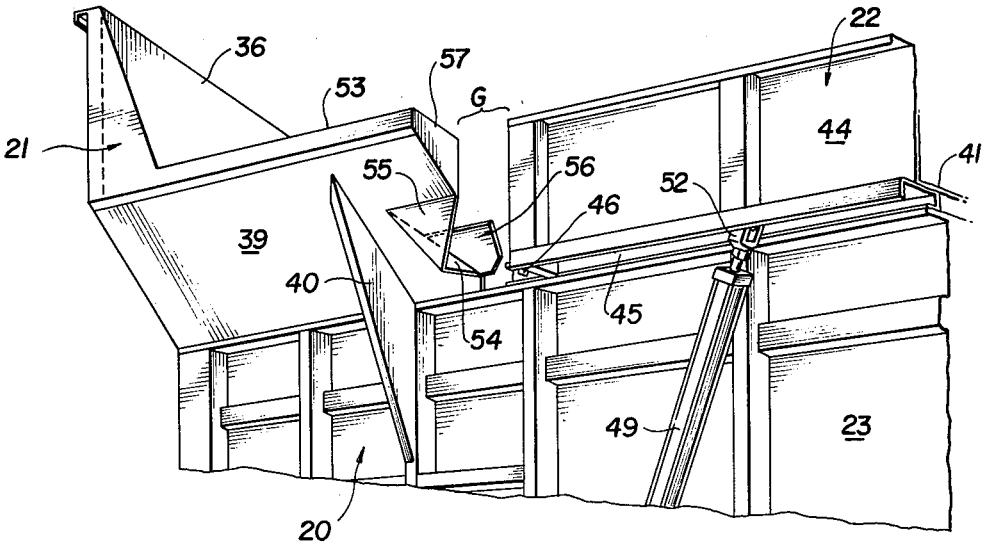
FIG.2

FIG. 3
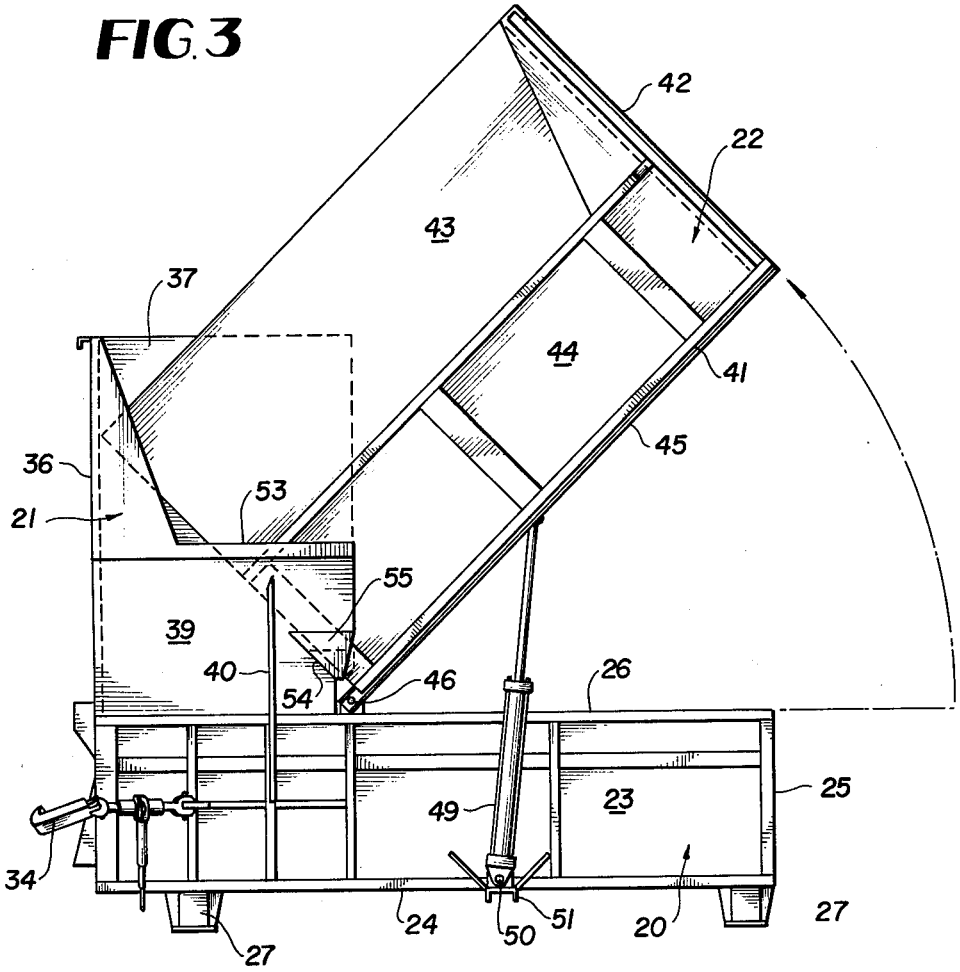
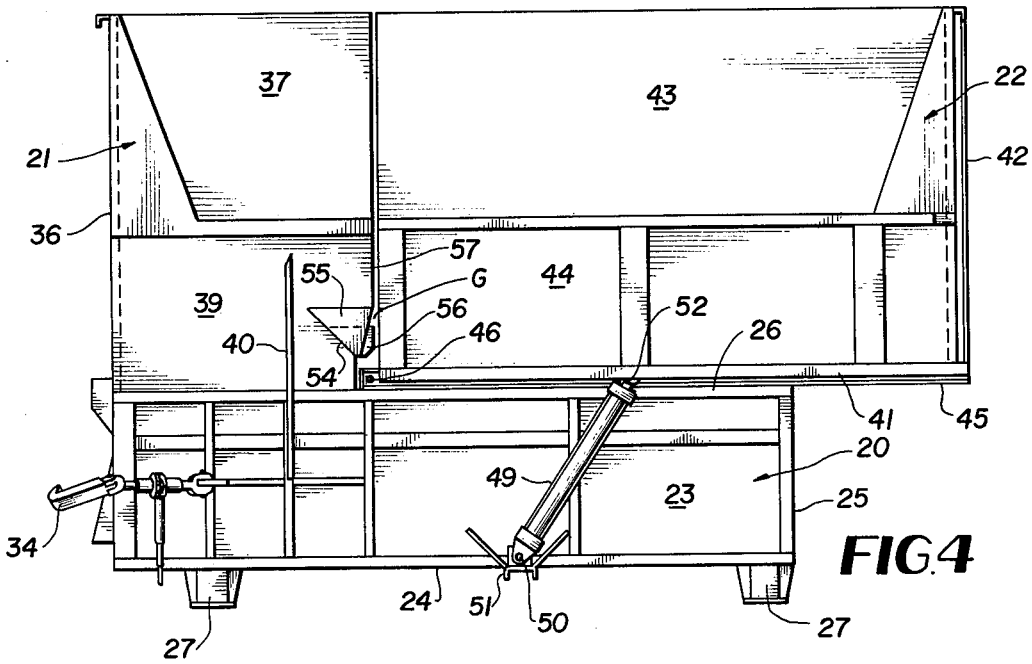
FIG. 4

FIG. 5
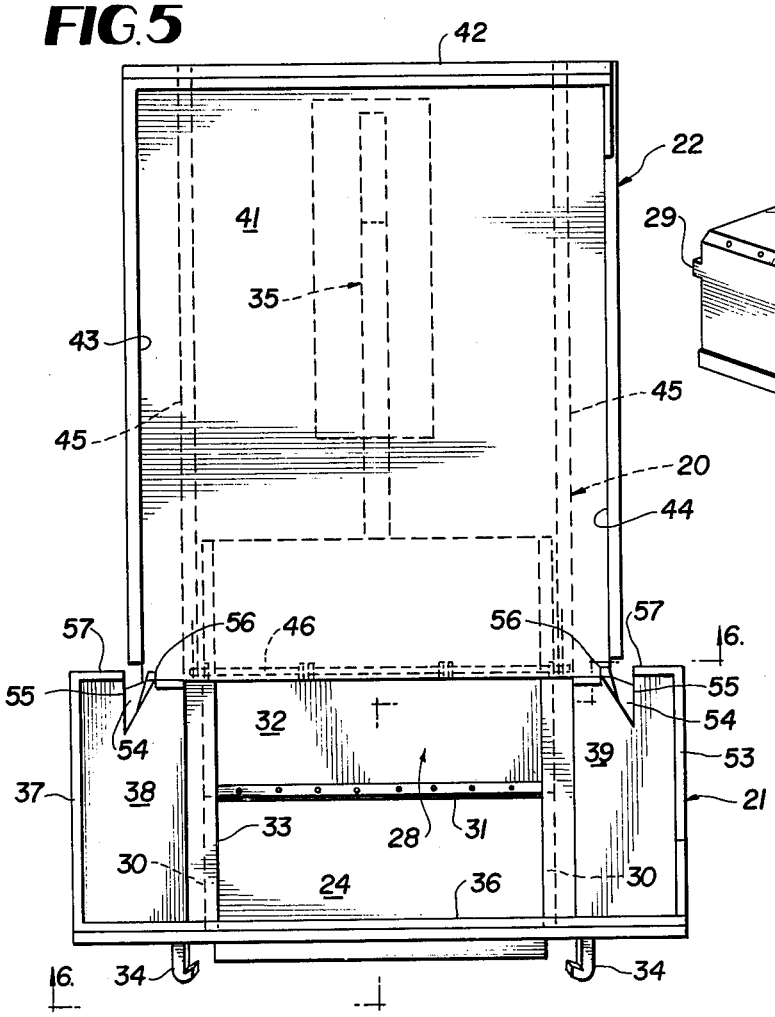
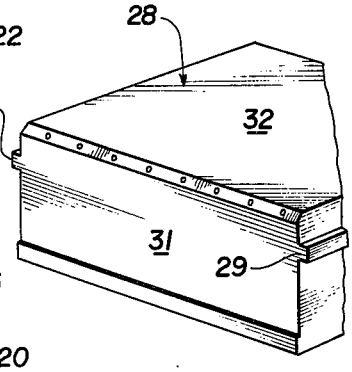
FIG. 7
FIG. 8
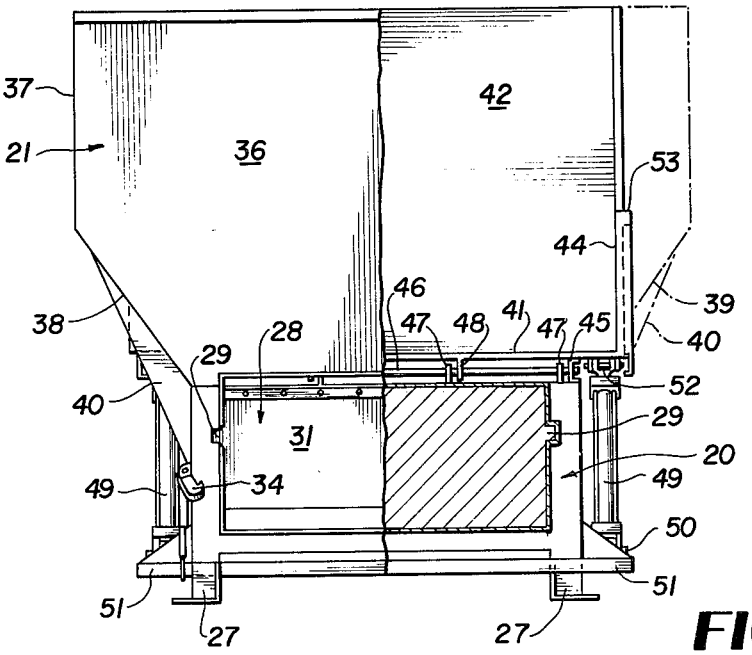
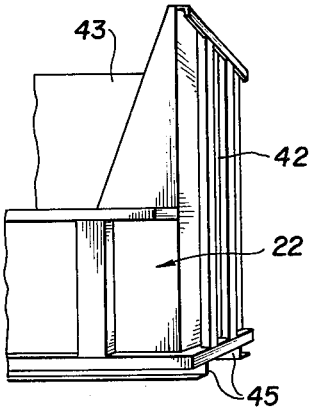
FIG. 6

DUMP COMPACTOR FOR REFUSE

BACKGROUND OF THE INVENTION

Numerous refuse loading, storage and compacting systems have been proposed in the prior art, and these systems vary widely in size, complexity and cost. Some larger industrial refuse handling systems are huge and complex and therefore extremely costly, and for this reason do not appeal to users. Smaller and less costly systems lack the volume capacity necessary to handle the refuse accumulations at recreation areas, large apartment houses and other living areas, and shopping centers.

Accordingly, there is a need in the art for a less costly and more efficient high volume refuse collector, storage means and compactor to satisfy the needs of recreation, living and shopping centers without the extremely high cost of industrial refuse systems but possessing much greater capacity than existing smaller installations presently available.

SUMMARY OF THE INVENTION

The refuse processing system according to the invention utilizes as a base a commercially available horizontal axis ram type comparatively low silhouette refuse compactor unit having means to couple releasably with large refuse transport containers. Upon this compactor unit base in tandem relationship are a fixed hopper bin having a bottom outlet opening which registers with an opening in the underlying compactor unit ahead of the horizontal ram thereof; and a coacting vertically swingable dumping bin which is raised to a steep angle above the compactor unit base to feed large volumes of refuse by gravity action into the fixed hopper bin. The side walls of the hopper and dumping bins at one side of the apparatus are cut downwardly to allow side loading of refuse by front end loaders and the like when the dumping bin is in a level position on the compactor unit base. The dumping bin is raised and lowered by power cylinder means on opposite sides of the compactor unit base.

The side walls of the hopper and dumping bins are constructed for a unique scissoring action without mechanical interference and/or refuse spilling.

BRIEF DESCRIPTION OF THE DRAWINGS

FIG. 1 is a perspective view of a refuse processing apparatus according to the invention.

FIG. 2 is a fragmentary perspective view of the apparatus to show particularly the construction of hopper bin and dumping bin side walls which facilitate scissoring during the dumping operation.

FIG. 3 is a side elevation of the apparatus with the dumping bin elevated.

FIG. 4 is a further side elevation of the apparatus with the dumping bin lowered and level.

FIG. 5 is a plan view of the apparatus.

FIG. 6 is an end elevational view, partly in section, taken on line 6—6 of FIG. 5.

FIG. 7 is a fragmentary perspective view of a refuse compactor ram.

FIG. 8 is a similar view showing the rear end portion of the swingable dumping bin.

DETAILED DESCRIPTION

Referring to the drawings in detail wherein like numerals designate like parts, a high volume refuse receiver and compacting apparatus in accordance with the invention comprises three main components, namely, a base unit 20 in the form of a commercial low silhouette horizontal axis ram compactor, a fixed hopper bin 21 on top of the ram compactor unit 20 near its discharge end, and a tiltable dumping bin 22 on the ram compactor base 20 in tandem relationship to the hopper bin 21 and somewhat overhanging the rear end of the unit 20, as shown in FIG. 4.

For the compactor unit base 20, a commercial apparatus manufactured and sold by Marathon Equipment Company, Inc., 1312 Borden Ave., Leeds, Ala. 35094 may be employed. Such unit is marketed under the designation Ram Jet, RJ-225HD. Any equivalent low silhouette horizontal axis ram compactor could be used for the purposes of the invention.

The compactor unit 20 is relatively shallow vertically and comprises a horizontally elongated rectangular cross section box-like body or frame having side walls 23, a bottom wall 24, a rear end wall 25, and a top wall 26, the forward end of the compactor unit frame being open, as clearly shown in FIG. 1. The unit 20 is supported in a level position on sturdy legs 27.

The conventional compactor unit 20 further comprises a horizontal axis reciprocating compactor ram 28 held within the confines of the rectangular cross section compactor unit body or frame and guided therein during reciprocation by the interaction of guide ribs 29 on the opposite sides of the ram 28 fitting slidably within horizontal grooves 30 in the opposite side walls of the unit 20. The front face 31 of the rectangular block-like ram 28 is vertical and disposed at right angles to the flat top face 32 of the ram.

The stationary hopper bin 21 is fixed to the top of compactor unit 20 as by welding and the hopper bin 21 has a bottom rectangular opening 33 arranged in registration with a like opening formed in the top wall of compactor unit 20. When the ram 28 is fully advanced to the refuse compacting position and adjacent to the open front end of the unit 20, its top face 32 forms a closure for the opening 33 of hopper bin 21, whereby refuse can be stored in the bin as well as in the dumping bin 22.

Periodically, a large refuse transport receptacle, not shown, of a conventional type is coupled end-to-end with the frame of compactor unit 20 by a pair of releasable hooks 34 provided on opposite sides of the unit 20. When the transport receptacle is thus coupled mouth-to-mouth with the unit 20, the ram 28 is reciprocated to force refuse from the unit 20 into the transport receptacle in a highly compacted state. As shown schematically in FIG. 5, the ram 28 is reciprocated horizontally by conventional power and control means 35 contained within the unit 20 rearwardly of the ram and connected therewith. When the transport receptacle is uncoupled from the unit 20 and taken to a suitable dumping site, the ram 28 can remain in a full forward position so that its top surface 32 will close the bottom opening 33 of hopper bin 21, as previously explained.

The fixed hopper bin 21 is a large capacity bin open at its top and including a forward vertical wall 36 and one vertical side wall portion 37. Below the vertical side wall portion 37 the hopper bin has a sloping side wall portion 38 and a like sloping side wall portion 39 is provided on the opposite side of the hopper bin 21. The sloping wall portions 38 and 39 funnel the refuse into the bottom opening 33 of the hopper bin. The sloping side walls of the hopper bin 21 considerably overhang the opposite sides of the comparatively narrow compactor unit base 20 and therefore the side walls of the hopper bin are buttressed by vertical reinforcing plates 40, as shown in the drawings.

The dumping bin 22 is open at its top and forward end and includes a flat bottom wall 41, a vertical rear end wall 42, and one full height vertical side wall 43, preferably of the same height as the vertical side wall 37, FIG. 4. The opposite side wall 44 of dumping bin 22 is of drastically reduced height and preferably equal in height to the foreshortened sloping side wall 39 of hopper bin 21. This reduction in height of the corresponding side walls of the two bins 21 and 22 greatly facilitates loading of the apparatus with refuse by one or more front end loaders, or like equipment, operating at one side of the apparatus while the dumping bin 22 is level, FIG. 4. In this figure, it can be seen that a very wide refuse filling opening extending for the combined lengths of bins 21 and 22 is provided above the reduced height walls 39 and 44. This is an important feature of the invention contributing to its ability to process large quantities of refuse rapidly and efficiently.

The bottom of the tiltable dumping bin 22 is equipped with a pair of sturdy parallel channel rails 45 adapted to rest on the level top edges of the side walls 23 of compactor unit 20. The forward ends of these channel rails are pivotally connected with a single long transverse horizontal hinge rod 46 extending through apertures in upstanding and depending knuckles 47 and 48 secured, respectively, to the top of compactor unit 20 and to the bottom of dumping bin 22, thus forming a very sturdy hinge structure, FIG. 6.

The dumping bin 22 is raised and lowered around the axis of this hinge structure by a coordinated pair of side hydraulic cylinders 49 having their lower ends pivotally attached as at 50 to outboard horizontal rigid platform extensions 51 on opposite sides of the unit 20 adjacent to its bottom wall. The tops or rod ends of cylinders 49 are pivotally coupled as at 52 to dumping bin 22 near the longitudinal center thereof. The two cylinders 49 lie close to the side walls 23 of unit 20 and beneath the overhanging longitudinal side walls of the dump bin 22, which, like the hopper bin 21, is wider than the compactor unit 20. The cylinders 49 may be conventionally controlled by electromechanical means, not shown, to elevate and lower the bin 22 at proper times. When fully elevated, FIG. 3, the bottom wall of bin 22 is at an angle of about forty-five degrees to the top of compactor unit 20.

A unique feature of the invention resides in a scissoring action of the dumping bin side walls 43 and 44 relative to the hopper bin side walls when the dumping bin is raised and lowered. As clearly shown in FIGS. 1, 2 and 5, the dumping bin side walls 43 and 44 are spaced laterally inwardly of hopper bin vertical side wall portion 37 and the top level edge 53 of vertically foreshortened inclined side wall 39. As shown in FIG. 5, the dumping bin side walls 43 and 44 intersect the planes of hopper bin sloping side walls 38 and 39, and therefore during swinging of the dumping bin 22 some clearance means for the side walls 43 and 44 must be provided to prevent interference between them and the sloping walls 38 and 39.

This means, as best shown in FIG. 2, comprises on each sloping wall 38 and 39 at the rear end of hopper bin 21 an inclined clearance wall 54 bounded on the outer side by a vertical hopper offset wall 55 joined to the sloping walls 38 and 39, and bounded on the inside by a vertical refuse deflector plate 56. A retaining plate or flange 57 extends inwardly from each sloping side wall 38 and 39, as best shown in FIG. 2. When dumping bin 22 is elevated, FIG. 3, and the scissoring action between the walls 43–44 and 38–39 takes place, the leading edges of the walls 43 and 44 may enter between the space plates 55 and 56 and above the clearance wall 54 without mechanical interference. The deflector plate 56 and the retaining flange 57 help to insure that no spillage of refuse occurs during the tilting or dumping operation of the bin 22. FIG. 4 shows clearly how the refuse deflector plate 56 projects into the gap which exists between the rear of hopper bin 21 and the front of dumping bin 22. The gap G in FIG. 2 is exaggerated in size in this figure for clarity of illustration while in actuality, FIG. 4, the gap G is quite narrow.

As shown clearly in the drawings, the top edges of the hopper and dumping bins and the side and rear walls of the dumping bin are heavily reinforced for strength and durability in a rough environment. The apparatus can be constructed in various sizes to satisfy various needs or capacities.

It should now be clear that the apparatus essentially comprises a low base formed by the horizontal axis ram compactor unit 21 and the fixed and tiltable hopper and dumping bins 21 and 22 superimposed on the base, with power means to raise and lower the dumping bin 22, means to facilitate scissoring of the bin side walls without interference or refuse spillage, and means to facilitate side loading into both bins when the dumping bin is level. This last means is the reduced height side walls on the two bins 21 and 22 along one side thereof.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A refuse receiving and compacting apparatus comprising in combination a horizontal axis ram-type compactor unit forming a base for the apparatus, said compactor unit having a discharge end adapted for coupling releasably to a refuse transport receptacle, a hopper bin fixed on top of the compactor unit near said discharge end and having a bottom outlet opening in registration with a top opening of the compactor unit forwardly of the ram of the compactor unit, the hopper bin being open at its top and rear and including front and side walls, a coacting dumping bin mounted on top of said compactor unit rearwardly of the hopper bin and in tandem relation thereto, the dumping bin being open at its top and front and having bottom, side and rear walls, means hingedly connecting the forward end of the dumping bin to the compactor unit, and power means coupled between the dumping bin and compactor unit to raise and lower the dumping bin around the axis of the first-named means, the side walls of said hopper bin and dumping bin being constructed and arranged for scissoring action without interference during the raising and lowering of the dumping bin, and the side walls of the hopper bin and dumping bin along one side of the apparatus being of reduced height compared to the opposite side walls and the front and rear walls of the two bins to promote side loading of the apparatus when the dumping bin is in a level position.

2. A refuse receiving and compacting apparatus as defined in claim 1, and said hopper bin being wider than the compactor unit and including sloping side wall portions which project outwardly beyond and above the corresponding side walls of the compactor unit, the side walls of the dumping bin being substantially vertical and lying laterally inwardly of the outer extremities of said sloping side walls but intersecting the planes of the sloping side walls of the hopper bin during tilting of the dumping bin, and recess means on the sloping side walls of the hopper bin to accommodate the leading edges of the side walls of the dumping bin without interference during tilting of the dumping bin to a dumping position in relation to the hopper bin.

3. A refuse receiving and compacting apparatus as defined in claim 2, and said recess means comprising outer vertical offset walls on said sloping side walls and depending therefrom, inclined clearance walls attached to the bottoms of said offset walls and extending inwardly thereof, and interior upstanding refuse deflector plates on the clearance walls spaced from and substantially parallel to the offset walls, the leading edges of the dumping bin side walls entering between the offset walls and refuse deflector plates during tilting of the dumping bin.

4. A refuse receiving and compacting apparatus as defined in claim 1, and said power means comprising a pair of power cylinder-piston units coupled between side portions of the dumping bin which extend laterally outwardly of the side walls of the compactor unit and a pair of side platform extensions on the bottom of the compactor unit, said cylinder-piston units arranged close to the side walls of the compactor unit.

5. A refuse receiving and compacting apparatus as defined in claim 1, and a rear end portion of the dumping bin projecting horizontally beyond the rear end of the compactor unit when the dumping bin is level and resting on top of the compactor unit.

6. A refuse receiving and compacting apparatus as defined in claim 1, and said first-named means comprising a horizontal transverse axis hinge rod extending across the top of the compactor unit adjacent to the forward end of said dumping bin, coacting hinge knuckles engaging said hinge rod and rising from the top of the compactor unit and depending from the bottom wall of the dumping bin, and a pair of longitudinal parallel members on the bottom wall of the dumping bin in spaced relationship and having their leading ends connected with said hinge rod.

7. A refuse receiving and compacting apparatus as defined in claim 2, and external rigid support means for said sloping side wall portions connected between such portions and the side walls of the compactor unit.

8. A refuse handling apparatus comprising an elongated horizontal axis ram-type compactor unit forming a base for the apparatus and having a discharge open end adapted to be coupled to a refuse transport receptacle, a fixed hopper bin mounted on top of the compactor unit near the discharge end thereof and having a top and rear side opening and a bottom outlet opening in communication with an inlet opening of the compactor unit, a swingable dumping bin mounted on top of the compactor unit behind the hopper bin and in tandem with the latter and having a top and forward end opening communicating with said top and rear opening of the hopper bin, side walls of the hopper bin and dumping bin being arranged in offset relationship for scissoring action during swinging of the dumping bin to an elevated and inclined position to feed refuse into the hopper bin by gravity action, and power means to raise and lower the dumping bin.

* * * * *